US008695842B2

(12) United States Patent
Gonzalez Sanchez et al.

(10) Patent No.: US 8,695,842 B2
(45) Date of Patent: Apr. 15, 2014

(54) PROTECTOR FOR CONTAINERS

(76) Inventors: Jose Francisco Gonzalez Sanchez, Barcelona (ES); Francisco Javier Cana Martinez, Barcelona (ES)

( * ) Notice: Subject to any disclaimer, the term of this patent is extended or adjusted under 35 U.S.C. 154(b) by 0 days.

(21) Appl. No.: 13/497,947

(22) PCT Filed: Sep. 28, 2010

(86) PCT No.: PCT/ES2010/070592

§ 371 (c)(1),
(2), (4) Date: Sep. 24, 2012

(87) PCT Pub. No.: WO2011/039395

PCT Pub. Date: Apr. 7, 2011

(65) Prior Publication Data

US 2013/0043259 A1 Feb. 21, 2013

(30) Foreign Application Priority Data

Sep. 30, 2009 (ES) ..... 200930486 U

(51) Int. Cl.
*A47G 19/22* (2006.01)

(52) U.S. Cl.
USPC ..... 220/716; 220/718; 220/694; 220/269; 220/259.1; 220/256.1; 215/253; 215/251; 215/250; 215/235; 215/232

(58) Field of Classification Search
USPC ..... 220/254.1, 256.1, 257.1–257.2, 258.5, 220/259.1, 265–266, 269, 270, 276, 694, 220/716, 718, 906, FOR. 203–FOR. 207; 215/232–236, 250, 253–257
See application file for complete search history.

(56) References Cited

U.S. PATENT DOCUMENTS

| | | | | | |
|---|---|---|---|---|---|
| 2,990,077 | A | * | 6/1961 | Baarn | 215/256 |
| 3,204,805 | A | * | 9/1965 | May | 220/257.2 |
| 3,690,509 | A | * | 9/1972 | Kinoian et al. | 220/716 |
| 3,905,511 | A | * | 9/1975 | Groendal | 220/739 |
| 3,986,627 | A | * | 10/1976 | Zapp | 215/237 |
| 4,420,089 | A | * | 12/1983 | Walker et al. | 215/216 |
| 4,494,672 | A | * | 1/1985 | Pearson | 220/263 |
| 4,872,577 | A | * | 10/1989 | Smith | 220/739 |
| 4,895,270 | A | * | 1/1990 | Main et al. | 220/257.2 |
| 4,917,258 | A | * | 4/1990 | Boyd et al. | 220/240 |
| 4,927,048 | A | * | 5/1990 | Howard | 220/716 |
| 5,078,296 | A | * | 1/1992 | Amidzich | 220/838 |
| 5,119,955 | A | * | 6/1992 | Granofsky | 220/270 |
| 5,139,163 | A | * | 8/1992 | Diaz | 220/258.2 |
| 5,147,054 | A | * | 9/1992 | Pehr | 215/253 |

(Continued)

FOREIGN PATENT DOCUMENTS

| | | |
|---|---|---|
| DE | 19927779 | 12/2000 |
| EP | 1541476 | 6/2005 |
| FR | 2892394 | 4/2007 |
| FR | 2898110 | 9/2007 |

*Primary Examiner* — Mickey Yu
*Assistant Examiner* — Brijesh V. Patel
(74) *Attorney, Agent, or Firm* — Sturm & Fix LLP

(57) ABSTRACT

A protector for containers for improving hygiene conditions, especially for cans with an essentially cylindrical form. The protector includes an upper protector element covering the upper part of the container and a lower ring arranged peripherally around the container connected to the upper protector element by a hinge section. The upper protector element also includes a ring pull projecting towards the outside in a downwards direction from the body of the upper protector element and having a cambered form following the contour of the can.

7 Claims, 3 Drawing Sheets

(56) References Cited

U.S. PATENT DOCUMENTS

| | | | | | |
|---|---|---|---|---|---|
| 5,240,132 | A * | 8/1993 | Tucker | 220/212 |
| 5,273,176 | A * | 12/1993 | Diaz | 220/258.2 |
| D353,328 | S * | 12/1994 | Nuffer | D9/446 |
| 5,464,112 | A * | 11/1995 | Guillot | 215/254 |
| 5,582,314 | A * | 12/1996 | Quinn et al. | 220/326 |
| D383,978 | S * | 9/1997 | Loeb | D9/438 |
| 5,765,716 | A * | 6/1998 | Cai et al. | 220/740 |
| 6,047,852 | A * | 4/2000 | Evans et al. | 220/793 |
| 6,241,114 | B1 * | 6/2001 | Savino et al. | 220/257.1 |
| 6,360,909 | B1 * | 3/2002 | Bridge | 220/258.2 |
| 6,378,718 | B1 * | 4/2002 | Maggi et al. | 220/257.1 |
| 6,443,323 | B1 * | 9/2002 | DeRose | 220/257.1 |
| D475,923 | S * | 6/2003 | Renz | D9/446 |
| 6,601,728 | B1 * | 8/2003 | Newkirk et al. | 220/739 |
| 6,899,244 | B2 * | 5/2005 | Takayama | 220/257.2 |
| D517,916 | S * | 3/2006 | Satt | D9/449 |
| 7,017,769 | B1 * | 3/2006 | Talmon | 220/258.2 |
| D576,877 | S * | 9/2008 | Alcamo et al. | D9/449 |
| 2004/0056040 | A1 * | 3/2004 | Ziegler | 220/847 |
| 2004/0134913 | A1 * | 7/2004 | Kronseder et al. | 220/257.1 |
| 2006/0231563 | A1 * | 10/2006 | Olivar | 220/780 |
| 2006/0289548 | A1 * | 12/2006 | Schatz | 220/784 |
| 2007/0187410 | A1 * | 8/2007 | Legorreta et al. | 220/375 |
| 2007/0295737 | A1 * | 12/2007 | Del Val Catala | 220/716 |
| 2010/0059471 | A1 * | 3/2010 | Pehr | 215/201 |
| 2010/0320205 | A1 * | 12/2010 | Aranda Campin | 220/254.1 |
| 2011/0011869 | A1 * | 1/2011 | Pontes | 220/361 |

* cited by examiner

PROTECTOR FOR CONTAINERS

OBJECTIVE OF THE INVENTION

The aim of the present application of utility model is the registration of a protector for containers incorporating notable novelties and advantages.

More specifically, the invention relates to a protector for containers, especially cans with an essentially cylindrical form, said protector comprising an upper protector element covering the upper part of the container and a lower ring arranged peripherally around the container, improving the hygienic conditions of the container, and hence for the user's health.

BACKGROUND OF THE INVENTION

At present protector elements for mounting on containers are known, in particular containers commonly known as cans, with an aim to providing improved hygienic conditions to the area having the access opening to the inside contents, with respect to the current's presentation of said containers at commercial outlets, in which no kind of protection is available.

However, in practice it is noted that known protectors do not provide a sufficiently satisfactory hygiene of the area to be contacted by the lips of a user when drinking a beverage that is directly contained inside a container.

In addition, the applicant is not aware of the existence of an invention relating to a protector that has the characteristics described herein.

DESCRIPTION OF THE INVENTION

This invention has been developed with an aim to provide a protector for containers that solves the abovementioned disadvantages, also providing other, added advantages which will become obvious from the following description herein.

Therefore, it is an aim of this invention to provide a new protector for containers, especially for cans with an essentially cylindrical form, comprising an upper protector element covering the upper part of the container and a lower ring arranged peripherally around the container, and which is characterized essentially by the fact that said upper protector element includes a ring pull projecting towards the outside in a downwards direction from the body of said upper protector element and having a cambered form following the contour of the container.

Preferably, both the upper protector element and the lower ring are made of a biodegradable pliable plastic material, thus ensuring its degradation in a relatively short time and hence being environmentally friendly. Thanks to the above described characteristics, a protector is obtained with a low manufacturing cost, which has a higher level of hygiene than the protectors known in the art, as the contour of the can that is usually in contact with the user's lips when drinking directly from the container is protected from dirt in a simple and practical way. In addition, the described protector does not imply any discomfort or bother for the user when consuming the beverage contained inside the container. Advantageously, the upper protector element comprises a circumferential recessed section near the rim of the protector element, enabling an easy stacking of the cans each on top of one another for their storage by taking advantage of the flange that these containers have on their base.

It will be obvious to any person skilled in the art that there is the possibility that the protector defined by this invention forms part of a configuration made of multiple protectors joined together for exampled by ribs, to be applied to a group of cans arranged in a two-row configuration with a predetermined number of containers, such as is often seen in commercial outlets for the sale thereof.

In another particularly preferred embodiment of the invention, the lower ring has a body that is substantially truncated-cone shaped and that adapts to the container's body to be mounted, the opening being provided at least of a rib joining the two lateral sections of the opening. Said two lateral sections of the opening are joined by two ribs that run parallel to each other. On the other hand, the lower ring has an opening in which the ring pull can be placed snuggly, whose dimensions coincide with those of said opening.

Other features and advantages of the protector for containers which is the subject matter of this invention will become obvious from the description of a preferred, though non exclusive, embodiment, which is illustrated by means of a non limiting example in the attached drawings, in which:

DESCRIPTION OF A PREFERRED EMBODIMENT

Figure 1:
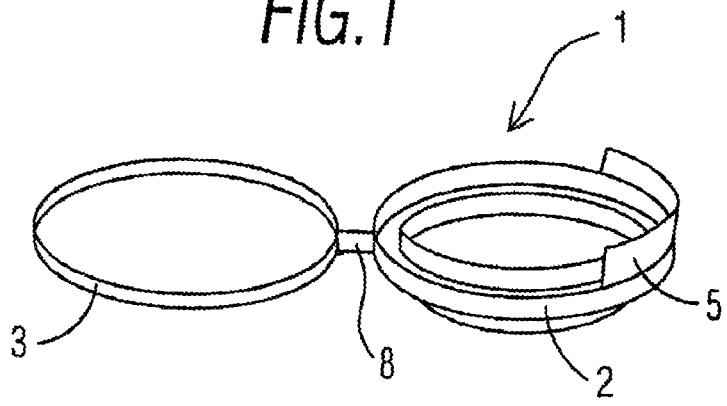
FIG. 1.—Perspective view of a first preferred embodiment of the protector for containers according to the invention.
Figure 2:
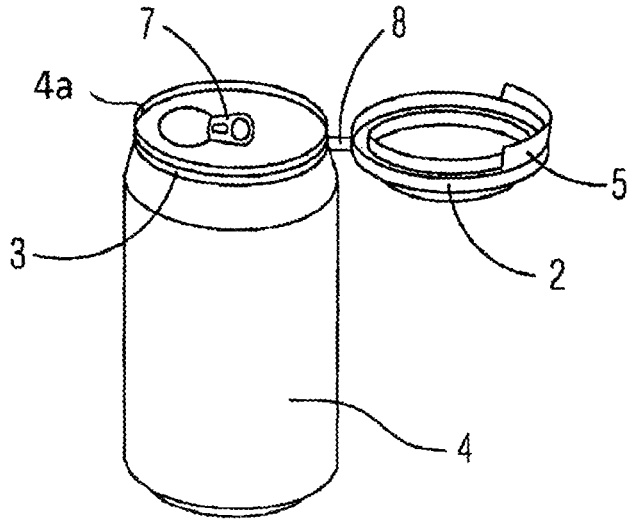
FIG. 2.—Perspective view of the protector represented in the above figure placed on a can in an open condition.

As shown in FIGS. 1 and 2, attached, a first embodiment of the protector for containers of the invention, especially for can-like containers with a substantially cylindrical shape, denoted in a general way by the reference number 1 comprises an upper protector element 2 covering the upper part of the container, and a lower ring 3 arranged snuggly around the rim 4*a* of the container 4, which is joined to the upper protector element 2 by means of a hinge section 8. Both the upper protector element 2 and the lower ring 3 are made of a biodegradable pliable plastic material with a polyethylene or polypropylene core together with several additives that favour oxo-biodegradation and hence the natural degradation of the protector described herein.

Said upper protector element 2 incorporates a protector ring pull 5 projecting towards the outside in a downwards direction from the body of said upper protector element 2 and having a cambered form following the contour of the container.

It is noted that the union between both elements forming the protector 1 is such that, in a closed condition, it provides tight closure, preserving optimal properties of the inside liquid, especially for carbonated beverages by preventing the exit of gas or of the liquid once the ring pull provided on the can-like container has been opened.

Figure 3:
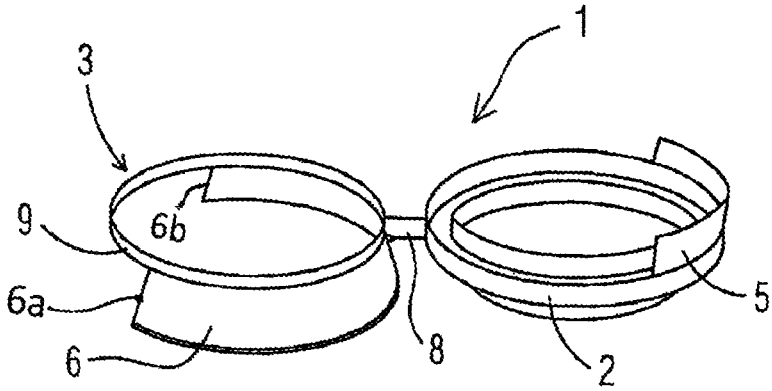
FIG. 3.—Perspective view of a second preferred embodiment of the protector for containers according to the invention.
Figure 4:
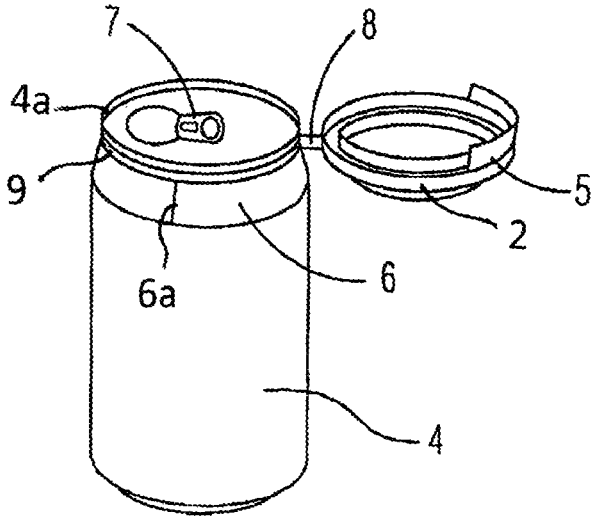
FIG. 4.—Perspective view of the protector represented in FIG. 3 placed on a can in an open condition.

In a second embodiment of the invention shown in FIGS. 3 and 4, elements equivalent to those above have the same number references; the lower ring 3 has a body 6 that is substantially truncated-cone shaped, an opening being provided with an upper rib 9 section joining the two sections 6*a* and 6*b* of the opening. In this way, the protector ring pull 5 can be snuggly fitted on the opening, whose dimensions coincide with those of the opening provided on the lower ring 3.

This protector 1 of the invention, in addition to providing hygiene protection previous to the opening of the container 4, for example through the can ring pull 7 provided on the upper base of the can container 4, provides hygiene and tightness once the container 4 has been opened, i.e. once the can ring pull 7 has been pulled out, so that the user can store inside the beverage for as long as convenient without worsening the conditions of the inside liquid to be consumed.

Figure 5:
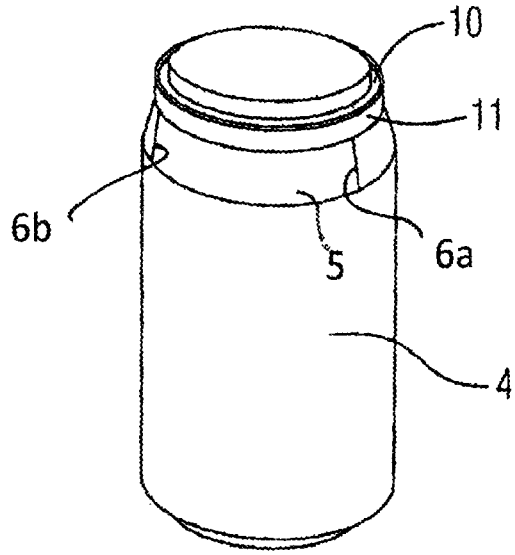
FIG. 5.—Perspective view of the protector on a can-like container in a closed condition, and FIG. 6.—Perspective view of a third embodiment of the protector for containers according to the invention in an open position.

Additionally, and as can be seen more clearly in FIG. 5, the upper protector element 1 comprises a circumferential recessed section 10 near the rim 11 of the protector element, enabling an easy stacking of other cans of equal or similar configuration, so that the containers can be stacked in the same way as if they had not the hygiene seal of the invention.

Figure 6:
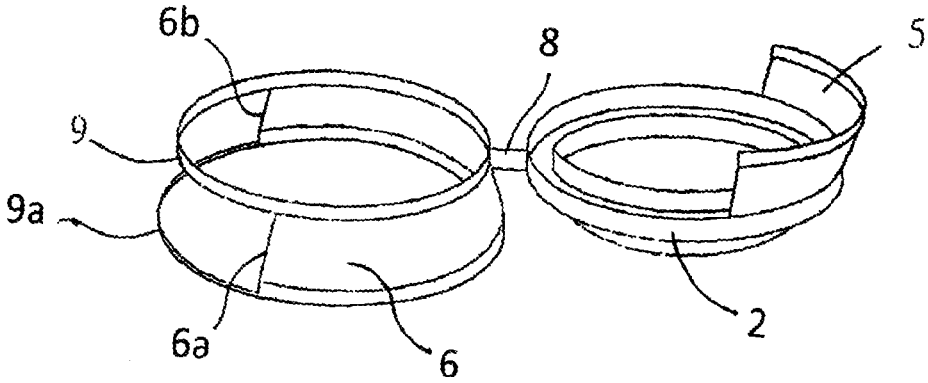

Finally, in FIG. 6 a third embodiment of the invention can be seen in which the two sections of the opening can be joined by two ribs 9 and 9*a* that run parallel to each other. The lower rib 9*a* can be used jointly with the protector ring pull 5 as safety seal by the application of, for example, breakable joining points arranged between the upper rim of the lower rib 9*a* and the lower rim of the protector ring pull 5. In this way, the consumer has the guarantee that the upper protector element 2 has not been tampered with. In this case, the upper rib 9 corresponds to a section of the lower ring 3 itself.

The details, shapes, dimensions and other accessory elements, as well as the materials used in the manufacturing of the protector for containers of the invention can be conveniently replaced by other technical equivalents without departing from the spirit nor scope of the invention as defined by the following claims.

The invention claimed is:

1. A protector for containers with a cylindrical form, comprising:

a container including an upper part that carries a can ring pull and a contoured sidewall;

an upper protector element covering the upper part of the container;

a lower ring arranged peripherally around the container connected to the upper protector element by means of a hinge section, wherein said upper protector element includes a protector ring pull projecting towards the outside in a downwards direction from a body of said upper protector element and having a cambered form following the contoured sidewall of the container; and wherein the lower ring is truncated-cone shaped, and has an opening being provided with an upper rib and a lower rib disposed parallel to each other.

2. The protector for containers according to claim 1 wherein the lower ring opening receives the protector ring pull, whose dimensions coincide with those of said opening.

3. The protector for containers according to claim 1 wherein a height of the protector ring pull coincides with a height of a truncated-cone shaped wall of the lower ring.

4. The protector for containers according to claim 1, wherein the protector ring pull is manufactured as an integral part of the upper protector element.

5. The protector for containers according to claim 1, wherein the upper protector element and the lower ring are made of a biodegradable pliable plastic material.

6. The protector for containers according to claim 1, wherein the upper protector element comprises a circumferential recessed section near the rim of the upper protector element.

7. A protector for containers with a cylindrical form, comprising:

a container including an upper part that carries a can ring pull and a contoured sidewall;

an upper protector element covering the upper part of the container;

a lower ring arranged peripherally around the container connected to the upper protector element by means of a hinge section, wherein said upper protector element includes a protector ring pull projecting towards the outside in a downwards direction from a body of said upper protector element and having a cambered form following the contoured sidewall of the container;

wherein the lower ring is truncated-cone shaped, and has an opening being provided with a rib; and wherein the lower ring opening receives the protector ring pull whose dimensions coincide with those of said opening.

* * * * *